US010197237B2

(12) United States Patent
Kosugi et al.

(10) Patent No.: US 10,197,237 B2
(45) Date of Patent: Feb. 5, 2019

(54) LIGHTING DEVICE AND LIGHTING DEVICE FOR VEHICLE

(71) Applicant: Toshiba Lighting & Technology Corporation, Yokosuka-shi, Kanagawa (JP)

(72) Inventors: Daisuke Kosugi, Yokosuka (JP); Ryuji Tsuchiya, Yokosuka (JP); Toshihiro Hatanaka, Yokosuka (JP)

(73) Assignee: TOSHIBA LIGHTING & TECHNOLOGY CORPORATION, Yokosuka-shi (JP)

( * ) Notice: Subject to any disclaimer, the term of this patent is extended or adjusted under 35 U.S.C. 154(b) by 98 days.

(21) Appl. No.: 14/768,590

(22) PCT Filed: Sep. 20, 2013

(86) PCT No.: PCT/JP2013/075548

§ 371 (c)(1),
(2) Date: Nov. 19, 2015

(87) PCT Pub. No.: WO2014/136300

PCT Pub. Date: Sep. 12, 2014

(65) Prior Publication Data

US 2016/0061404 A1 Mar. 3, 2016

(30) Foreign Application Priority Data

Mar. 5, 2013 (JP) ..... 2013-043360
Mar. 6, 2013 (JP) ..... 2013-044454

(51) Int. Cl.
*F21S 43/19* (2018.01)
*F21S 43/14* (2018.01)
(Continued)

(52) U.S. Cl.
CPC ..... *F21S 43/195* (2018.01); *F21S 43/14* (2018.01); *F21S 45/47* (2018.01); *F21S 43/31* (2018.01); *F21S 43/37* (2018.01)

(58) Field of Classification Search
CPC ..... F21S 48/212; F21S 48/215; F21S 48/328; F21S 43/195; F21S 43/14; F21S 43/37; F21S 43/31; F21S 45/47
(Continued)

(56) References Cited

U.S. PATENT DOCUMENTS 8,358,073 B2 1/2013 Hayashi et al.
2009/0213469 A1* 8/2009 Braune ..... B29C 45/1615 359/642
2012/0218773 A1 8/2012 Peiler et al.

FOREIGN PATENT DOCUMENTS

JP 2008305718 A 12/2008
JP 2010129501 A 10/2010
(Continued)

OTHER PUBLICATIONS

Japanese Office Action, Japanese Patent Application No. 2013-043360, dated Jun. 14, 2016, English Translation included, 3 pages.
(Continued)

*Primary Examiner* — Anh T Mai
*Assistant Examiner* — Meghan K Ulanday
(74) *Attorney, Agent, or Firm* — Ulmer & Berne LLP

(57) ABSTRACT

A lighting device according to an embodiment includes a socket unit, a light emitting unit, and a lid unit. The light emitting unit is provided in an accommodation unit of the socket unit, and includes a light emitting element. The lid unit closes the accommodation unit of the socket unit, and is formed with an opening portion which causes light radiated from the light emitting element to pass through. An end face of the light emitting unit on the opening portion side overlaps with the opening portion in the thickness direction of the lid unit, and is located on the light emitting unit side rather than an end face of the lid unit on a side opposite to the light emitting unit side.

8 Claims, 8 Drawing Sheets

(51) Int. Cl.

| | |
|---|---|
| ***F21S 45/47*** | (2018.01) |
| *F21S 43/37* | (2018.01) |
| *F21S 43/31* | (2018.01) |

(58) Field of Classification Search
USPC ..... 362/516
See application file for complete search history.

(56) References Cited

FOREIGN PATENT DOCUMENTS

| | | | |
|---|---|---|---|
| JP | 2011-119168 | A | 6/2011 |
| JP | 2011-129308 | A | 6/2011 |
| JP | 2011-171276 | A | 9/2011 |
| JP | 2011/192403 | A | 9/2011 |
| JP | 2012-038698 | A | 2/2012 |
| JP | 2012-043750 | A | 3/2012 |
| JP | 2013-506251 | A | 2/2013 |
| WO | 2011037571 | A1 | 3/2011 |

OTHER PUBLICATIONS

International Search Report for PCT/JP2013/075548; dated Oct. 28, 2013.

Japanese Office Action dated Jun. 14, 2016, English Translation included, 3 pages.

Allen, Katie, Extended European Search Report, including supplementary European search report and search opinion issued in Europe for Patent Application No. EP 13 87 7326; dated Dec. 13, 2016; 8 pages.

* cited by examiner

LIGHTING DEVICE AND LIGHTING DEVICE FOR VEHICLE

CROSS-REFERENCE TO RELATED APPLICATIONS

This application is the National Stage of International Application No. PCT/JP2013/075548, filed on Sep. 20, 2013 which designated the United States, and which claims the benefit of priority from Japanese Patent Applications No. 2013-044454, filed on Mar. 5, 2013, and No. 2013-044454, filed on Mar. 6, 2013; the entire contents of which are incorporated herein by reference.

FIELD

Embodiments described herein relate generally to a lighting device and a lighting device for vehicle.

BACKGROUND

A lighting device in which a light emitting element is used as a light source, for example, a lighting device for a vehicle, is used in a front combination lamp or a rear combination lamp. When a light emitting element is used as a lighting device, countermeasures against heat of the light emitting element become important. The reason for this is that a light emitting element has a property in which light emitting efficiency decreases along with a temperature rise in the element itself. In particular, in a lighting device for vehicle, since the light emitting element is an in-vehicle element, it is necessary to maintain a function thereof under a usage environment from a low temperature of −40° C. to a high temperature of 85° C., and accordingly, countermeasures against heat under a high temperature environment are important. In addition, in the lighting device for vehicle, since miniaturization is necessary and it is not possible to sufficiently secure an area for heat radiation, countermeasures against heat become more important. In a lighting device for vehicle, a substrate with a light emitting element mounted thereon is separated from the outside, and thus there are lighting devices for vehicle having a lid unit formed of a lens or a prism which covers the substrate including the light emitting element.

DETAILED DESCRIPTION

Figure 1:
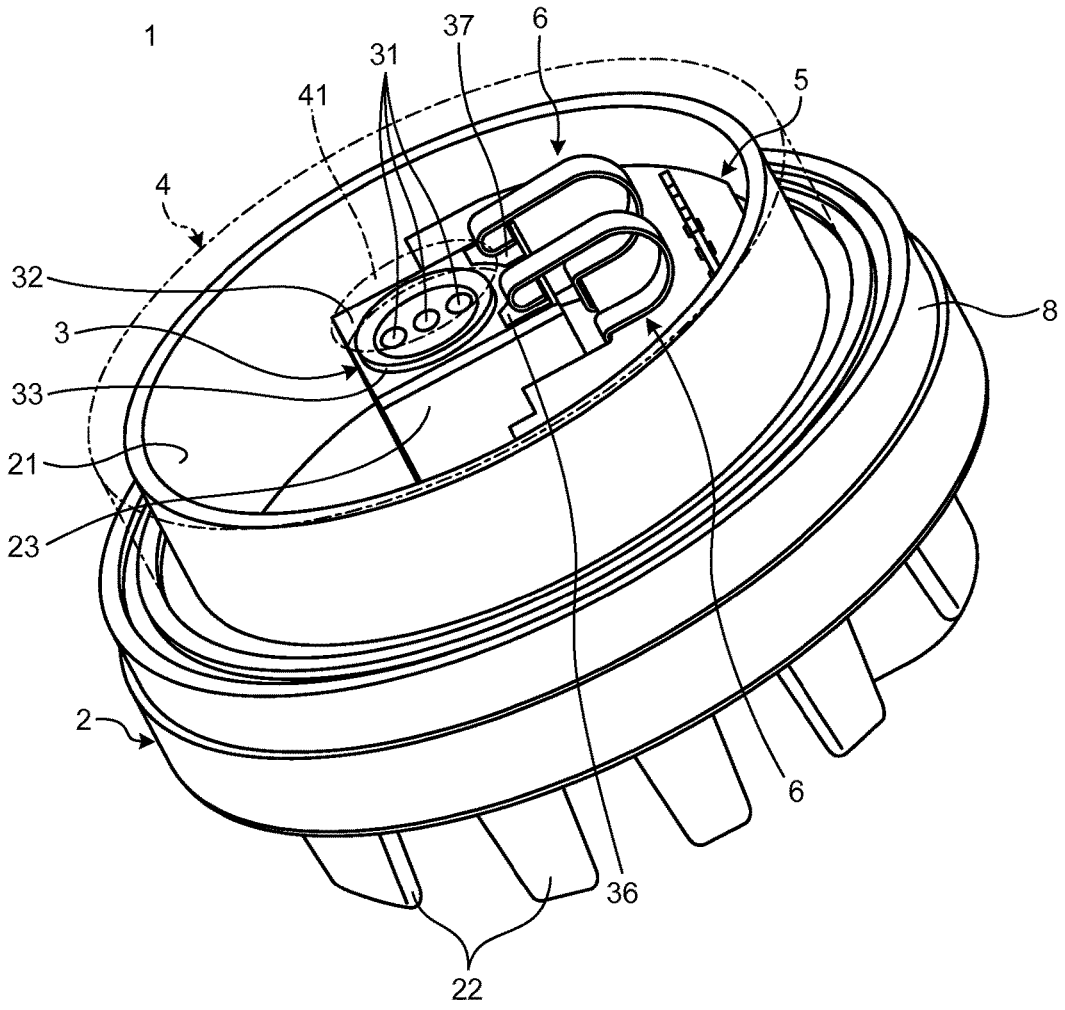
FIG. 1 is a diagram which illustrates a lighting device according to an embodiment.

An object of exemplary embodiments is to provide a lighting device with excellent heat radiation properties.

In general, a lighting device according to an embodiment includes a socket unit, a light emitting unit, and a lid unit. The light emitting unit is provided in an accommodation unit of the socket unit, and includes a light emitting element. The lid unit closes the accommodation unit of the socket unit, and is formed with an opening portion which causes light radiated from the light emitting element to pass through. An end face of the light emitting unit on the opening portion side overlaps with the opening portion in the thickness direction of the lid unit, and is located on the light emitting unit side rather than an end face of the lid unit on a side opposite to the light emitting unit side.

According to the exemplary embodiment, it is possible to provide a lighting device and a lighting device for vehicle with excellent heat radiation properties.

A lighting device 1 according to an embodiment which will be described below includes a socket unit 2, a light emitting unit 3, and a lid unit 4. The light emitting unit 3 is provided in an accommodation unit 21 of the socket unit 2, and includes a light emitting element 31. The lid unit 4 closes the accommodation unit 21 of the socket unit 2, and is formed with an opening portion 41 which causes light radiated from the light emitting element 31 to pass through. An end face of the light emitting unit 3 on the opening portion 41 side (light emitting unit top face 3*a*) overlaps with the opening portion 41 in the thickness direction of the lid unit 4, and is located on the light emitting unit 3 side rather than an end face of the lid unit 4 on a side opposite to the light emitting unit 3 side (lid unit top face 4*a*).

In the lighting device 1 according to the embodiment, the opening portion 41 is formed so as to be larger than the outer periphery of the light emitting unit 3.

In the lighting device 1 according to the embodiment, the opening portion 41 is configured of a slope face 41*a* in which the width of the inner peripheral face becomes large toward the opposite side from the light emitting unit 3 side.

In the lighting device 1 according to the embodiment, an opening angle $\alpha$ which is an angle in a section of the slope face 41*a* including the thickness direction of the lid unit 4 is equal to or greater than a half value angle $\beta$ of a light intensity of the light emitting unit 3.

In the lighting device 1 according to the embodiment, the slope face is a reflecting face which reflects light radiated from the light emitting element 31.

A lighting device for vehicle 100 according to an embodiment which will be described below includes at least one or more lighting devices 1.

The lighting device for vehicle 100 according to the embodiment includes a lighting device 1, and a lighting tool 110. The lighting device 1 radiates light into the lighting tool 110.

The lighting tool 110 includes a reflector 111 which has a reflector reflecting face 111*a*, and a light transmission unit 112. When setting reflectance of the reflector reflecting face 111*a* to A ($\lambda$), and reflectance of a lid unit reflecting face 42 to reflectance B ($\lambda$) in a wavelength of light $\lambda$, it satisfies B $(\lambda) \geq A(\lambda) \times 0.7$ in a wavelength range of light which is radiated from the lighting device 1.

Embodiment

Figure 2:
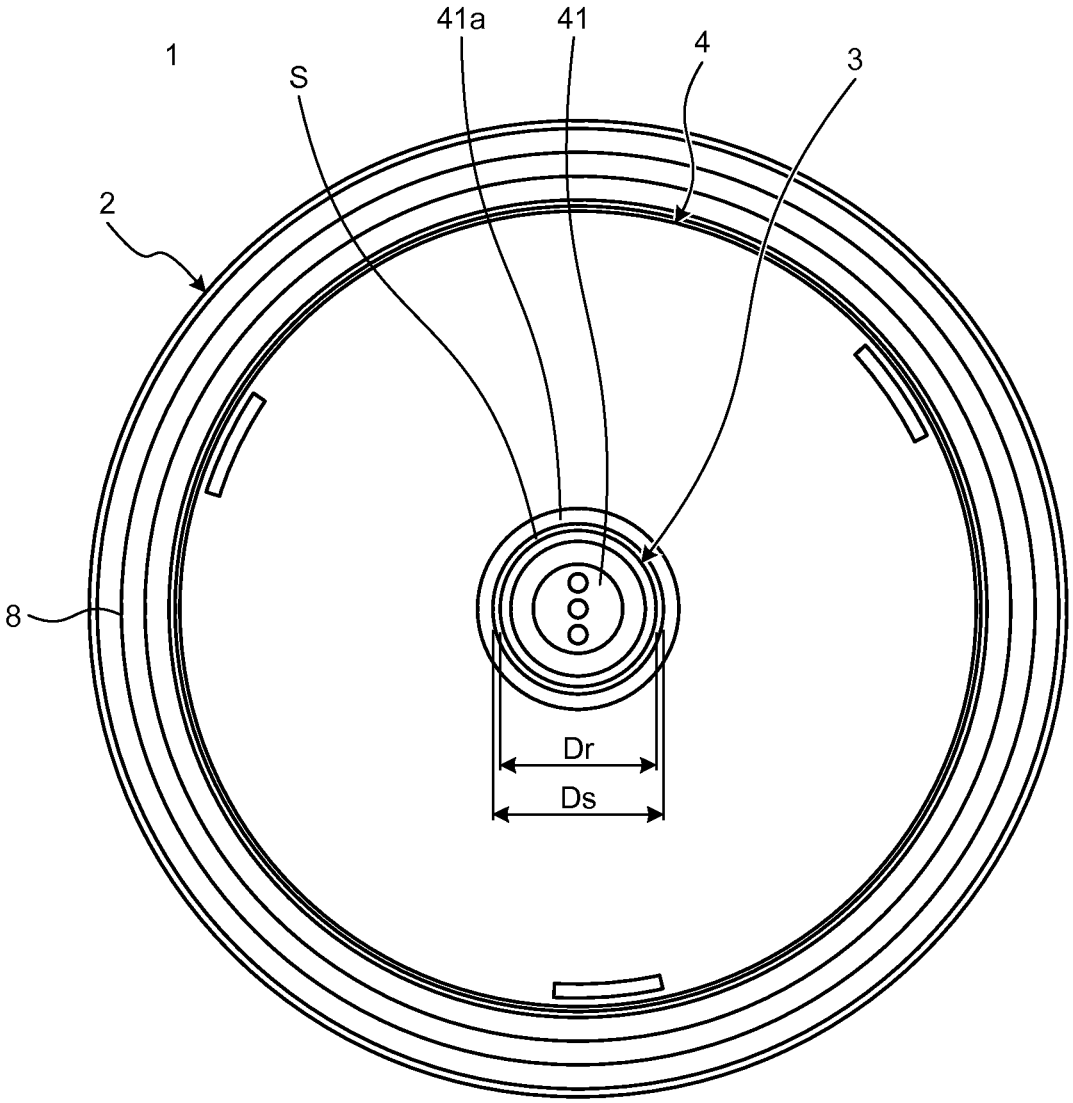
FIG. 2 is a diagram which illustrates a state in which the lighting device in the embodiment is viewed from a lid side.
Figure 3:
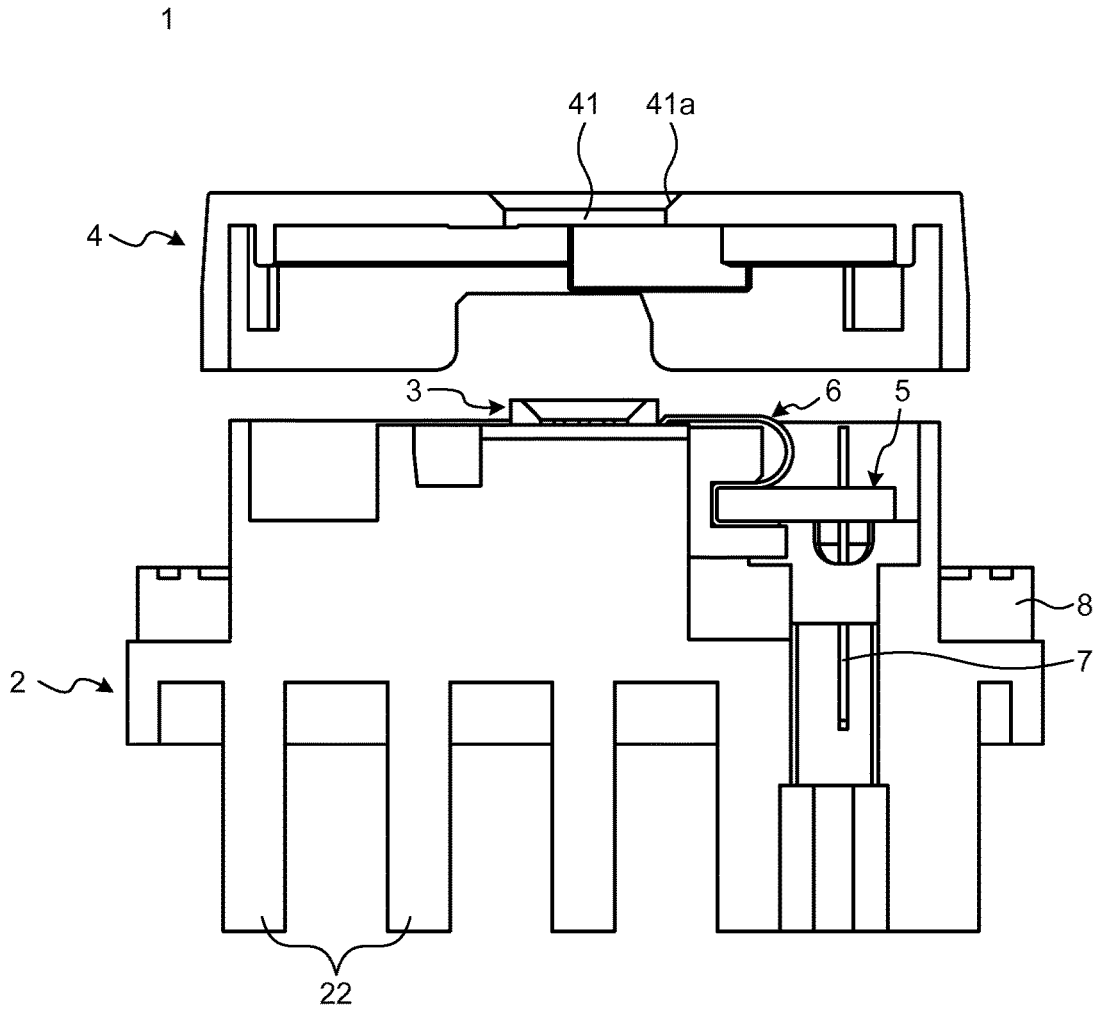
FIG. 3 is a diagram which illustrates a state in which a lid unit of the lighting device in the embodiment is disintegrated.
Figure 4:
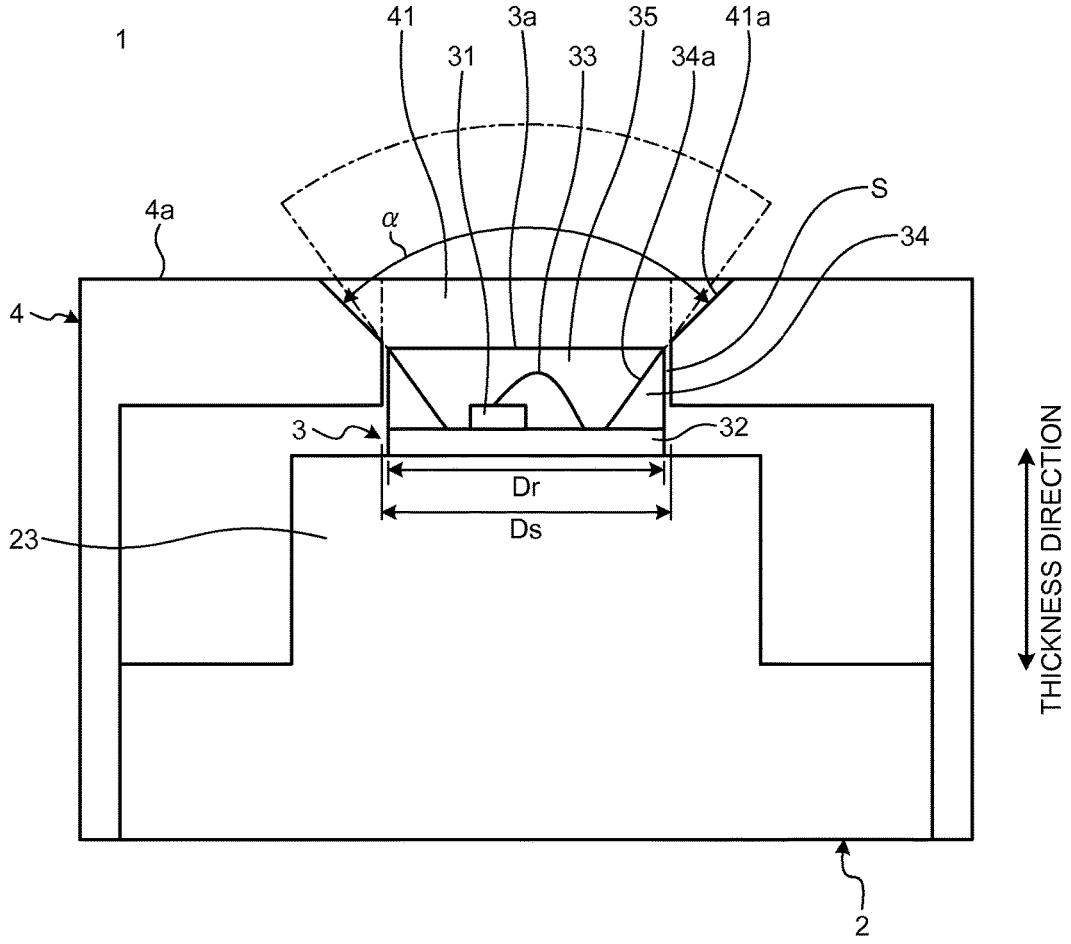
FIG. 4 is a schematic diagram which illustrates a relationship between an opening portion and a light emitting unit according to the embodiment.
Figure 5:
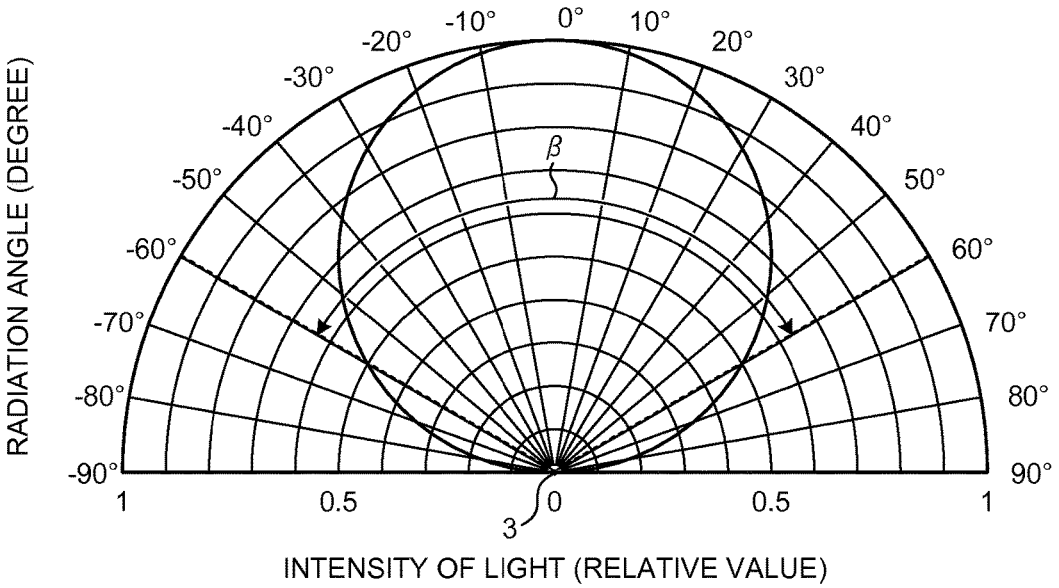
FIG. 5 is a diagram which illustrates light distribution properties of the light emitting unit.

An embodiment will be described with reference to FIGS. 1 to 5. FIG. 1 is a diagram which illustrates a lighting device according to the embodiment. FIG. 2 is a diagram which illustrates a state in which the lighting device in the embodiment is viewed from a lid side. FIG. 3 is a diagram which illustrates a state in which a lid unit of the lighting device in the embodiment is disintegrated. FIG. 4 is a schematic diagram which illustrates a relationship between an opening portion and a light emitting unit according to the embodiment. FIG. 5 is a diagram which illustrates light distribution properties of the light emitting unit. In addition, in FIG. 5, a horizontal axis denotes an intensity of light which is radiated from the light emitting unit, and an axis in a circumferential direction denotes a radiation angle.

The lighting device according to the embodiment is a lighting device for vehicle which is used in exterior or interior of a vehicle, and is, for example, a stop lamp, a tail lamp, a turn signal lamp, and a fog lamp which configure a front combination lamp, a rear combination light, and the like. These are configured by including a lens, a reflector, a lighting device, and a sealing member which seals the reflector and the lighting device. As illustrated in FIGS. 1 to 3, in the lighting device 1, the light emitting unit 3, a lighting circuit unit 5, a power feeding connection unit 6 are accommodated in the accommodation unit 21 of the socket unit 2, and the accommodation unit 21 is closed using the lid unit 4.

The socket unit 2 accommodates at least the light emitting unit 3, and radiates heat from the light emitting unit 3. In the socket unit 2, the light emitting unit 3 and a component for supplying power to the light emitting unit 3, for example, the lighting circuit unit 5 or the like, are accommodated in the accommodation unit 21. As illustrated in FIG. 3, an external power supply (not illustrated) which is provided at the outside of the lighting device 1, for example, a power feeding member 7 which is electrically connected to a battery (not illustrated) mounted on a vehicle is built in the socket unit 2. The socket unit 2 is configured of a resin material, and according to the embodiment, as illustrated in FIG. 1, a heat sink 22 which is formed of metal is attached to a main body which is formed of a resin material in order to improve heat radiation properties. A configuration in which the socket unit 2 and the heat sink 22 are integrally molded in a resin with high radiating properties, or the like, may be adopted.

The light emitting unit 3 radiates light, and includes a light emitting element 31 which is mounted on the light emitting element substrate 32. The light emitting element 31 is a semiconductor element which radiates light such as an LED or an LD, and one or more light emitting elements, according to the embodiment, a plurality of light emitting elements are mounted on the light emitting element substrate 32 in series. As illustrated in FIG. 4, each light emitting element 31 is electrically connected to the light emitting element substrate 32 through a wire 33. In the light emitting unit 3, a reflector 34 which reflects light from the light emitting element 31 is provided so as to surround all of the light emitting elements 31. The reflector 34 is configured of a slope face 34*a* in which the width of the inner peripheral face becomes large from the light emitting element substrate 32 side to the lid unit 4 side. In the light emitting unit 3, the light emitting element 31 is sealed using a resin by causing a space which is formed due to the reflector 34 to be filled with the resin having permeability, in order to prevent a damage of the light emitting element 31 and cutoff of the wire 33. As illustrated in FIG. 1, in the light emitting element substrate 32, element substrate side terminals 36 and 37 which are power feeding terminals with which the power feeding connection unit 6 comes into contact are formed. The element substrate side terminals 36 and 37 are formed on a face on a side on which the light emitting element 31 is mounted (lid unit 4 side), and are electrically connected to each light emitting element 31 through wiring which is not illustrated (including component such as resistor). Here, the light emitting element substrate 32 is an insulating substrate which is fixed to a mount 23 which is formed in the accommodation unit 21, and is formed of a material in which transfer of heat which is generated in the light emitting element 31 is easy such as metal with high thermal conductivity, or ceramics. An electrical connection between each light emitting element 31 and the element substrate side terminals 36 and 37 may be performed either in parallel or in series.

Here, the light emitting unit 3 is electrically connected to the lighting circuit unit 5 through the power feeding connection unit 6. The lighting circuit unit 5 is a substrate which lights up the light emitting element 31, and a substrate which is separately formed from the light emitting unit 3. The lighting circuit unit 5 is a driving circuit of the light emitting unit 3, and supplies power to the light emitting unit 3. In the lighting circuit unit 5, a circuit substrate side terminal (not illustrated) which is a power feeding terminal with which the power feeding connection unit 6 comes into contact is formed. The circuit substrate side terminal is formed on a face on a base portion side of the accommodation unit 21 which is a side opposite to the lid unit 4 side, and is electrically connected to the power feeding member 7, as illustrated in FIG. 3, through wiring which is not illustrated (including component such as current limiting resistor). Here, the lighting circuit unit 5 is fixed to a base portion side rather than the light emitting unit 3 in the accommodation unit 21, that is, to the lower part, and is an insulating substrate which is formed of a cheap material such as paper phenol, paper epoxy, or glass epoxy, since heat transfer is not considered to be important because a component with a high heating value such as each light emitting element 31 is not mounted thereon.

The power feeding connection unit 6 electrically connects the light emitting unit 3 and the lighting circuit unit 5, and according to the embodiment, the power feeding connection unit electrically connects both the element substrate side terminal 36 and a circuit substrate side terminal on one side, and the element substrate side terminal 37 and a circuit substrate side terminal on the other side, respectively. The power feeding connection unit 6 is arranged on the higher part of the light emitting unit 3 and the lighting circuit unit 5, and is an elastic material, for example, a flat spring which has electrical conductivity, for example. The power feeding connection unit 6 is in electrical contact with one of the light emitting unit 3 and the lighting circuit unit 5 by being fixed thereto, and is in electrical contact with the other in a state of being elastically deformed.

The lid unit 4 closes the accommodation unit 21 of the socket unit 2, and is fixed to the socket unit 2 through a packing 8 which is configured of an elastic material. That is, it is possible to prevent intrusion of external atmosphere from a portion which is fixed to the socket unit 2 of the lid unit 4 using the packing 8. Here, a fixing unit (not illustrated) is formed in the lid unit 4, and the lighting device 1 is fixed to a lighting device fixing target, for example, the lighting device 1 is fixed to the lighting device fixing target by being fixed to a lighting tool. The opening portion 41 through which light radiated from the light emitting element 31 is caused to pass is formed in the lid unit 4.

As illustrated in FIG. 4, the opening portion 41 is formed at a position facing the light emitting unit 3 in the thickness direction of the lid unit 4 (vertical direction of lighting device 1). The opening portion 41 functions as a ventilation port which causes the accommodation unit 21 to communicate with the outside. Here, when the lid unit 4 is fixed to the socket unit 2, the light emitting unit top face 3*a* which is an end face of the light emitting unit 3 on the opening portion 41 side is set so as to overlap with the opening portion 41 in the thickness direction of the lid unit 4. In addition, the light emitting unit top face 3*a* is set so as to be located on the light emitting unit 3 side rather than the lid unit top face 4*a* which is an end face of the lid unit 4 on a side opposite to the light emitting unit 3 side. That is, when the lid unit 4 is fixed to the socket unit 2, the light emitting unit 3 does not protrude from the opening portion 41, and the light emitting unit top face 3*a* is accommodated in the opening portion 41. Accordingly, when assembling, inspecting, attaching the lighting device 1 to the lighting device fixing target, or the like, it is possible to prevent a worker or a peripheral member from being in careless contact with the light emitting unit 3. In this manner, it is possible to suppress a damage of the light emitting unit 3, and to improve durability. In addition, since the light emitting unit top face 3*a* is located in the opening portion 41, and a part of the light emitting unit 3 which is a heat generation source of the lighting device 1 is located in the opening portion 41 which communicates with the outside, it is possible to suppress heat radiation to the accommodation unit 21, and to further improve heat radiation properties.

The opening portion 41 is formed so as to be larger than the outer periphery of the light emitting unit 3. According to the embodiment, the opening portion 41 is formed in a circular shape with a large diameter Ds with respect to the outer peripheral diameter Dr of the reflector 33 of the light emitting unit 3 which is formed in a circular shape. That is, in the lid unit 4, a gap S is formed with respect to the light emitting unit 3 when viewed in the thickness direction. Here, there is play when fixing the socket unit 2 and the lid unit 4, and there is a case in which the lid unit 4 moves on a level surface which is orthogonal to the thickness direction with respect to the socket unit 2. In this case, even when the lid unit 4 moves with respect to the socket unit 2, the opening portion 41 is formed in a size which does not make the light emitting unit 3 come into contact with the lid unit 4 when viewed in the thickness direction. Accordingly, since the gap S is formed, it is possible to secure a communication state between the accommodation unit 21 and the outside even when a part of the light emitting unit 3 is in the opening portion 41. In this manner, since it is possible to emit a heat in the accommodation unit 21 to the outside through the opening portion 41, it is possible to increase heat radiation effect. In addition, there is no case in which the gap S is disconnected even when the lid unit 4 moves with respect to the socket unit 2. That is, since the lid unit 4 does not come into contact with the light emitting unit 3, it is possible to prevent a part of own weight of the lighting device 1 except for the lid unit 4 from being received between the lid unit 4 and the light emitting unit 3 due to a vibration which comes from the outside, or the fixation of the lid unit 4 to the lighting device fixing target. In this manner, it is possible to suppress a damage of the light emitting unit 3, and to improve durability.

The opening portion 41 is configured of a slope face 41*a* in which the width of the inner peripheral face becomes large toward a side opposite to the light emitting unit 3 side, that is, the lid unit 4 side. Here, an opening angle $\alpha$ which is an angle of the slope face 41*a* in a section including the thickness direction of the lid unit 4 is set to be equal to or greater than the half value angle $\beta$ of intensity of light of the light emitting unit 3. In FIG. 5, a definition of the half value angle $\beta$ is illustrated. An angle numerical value which is described along the circumferential direction in the figure denotes a radiation angle of light from the light emitting unit 3, and an angle 0° denotes a direction in which the opening angle $\alpha$ of the slope face 41*a* becomes 0°. Intensity of light of the light emitting unit 3 is denoted on the horizontal axis in the figure, and intensity of light in each radiation angle is plotted using a solid line. As illustrated in FIG. 5, the half value angle $\beta$ is an opening angle which becomes 0.5 (half value) when intensity of light which is radiated from the light emitting unit 3 in a case of the opening angle 0° is set to 1. Here, the opening angle $\alpha$ is plus and minus directions around the opening angle 0°, and according to the embodiment, is approximately 120°, for example; however, the half value angle $\beta$ is changed depending on characteristics of the light emitting unit 3. In addition, it is preferable that the slope face 41*a* is set to be larger than an angle of inclination of the slope face 34*a* of the inner peripheral face of the reflector 34. In this manner, it is possible to prevent light which is radiated from the light emitting unit 3 from being shielded due to the slope face 41*a* which configures the opening portion 41.

Subsequently, operations of the lighting device 1 will be described. The lighting device 1 is fixed to the lighting device fixing target, and is formed with the power feeding member 7 electrically connected to the external power supply. When a supply of power from the external power supply is started, power from the external power supply which is supplied to the lighting circuit unit 5 through the power feeding member 7 is supplied to the light emitting element substrate 32 through the power feeding connection unit 6, and the light emitting unit 3 emits light when each light emitting element 31 emits light using supplied power. Light which is radiated from the light emitting unit 3 is radiated to the outside through the opening portion 41, and the lighting device 1 is turned on.

As described above, in the lighting device 1 according to the embodiment, since the opening portion 41 which causes the accommodation unit 21 to communicate with the outside is formed in the lid unit 4, it is possible to suppress a temperature rise in the lighting device 1 compared to a case in which the accommodation unit 21 is closed using the lid unit 4, since the opening portion 41 functions as a ventilation port. In particular, since the opening portion 41 is formed in the vicinity of the light emitting unit 3, it is possible to radiate heat generated in the light emitting unit 3 to the outside through the opening portion 41, and to increase a radiation effect. In this manner, since heat radiation properties are improved, it is possible to suppress lowering of efficiency which is caused by a temperature rise in the light emitting element 31, or the light emitting element substrate 32 and the lighting circuit unit 5, and to obtain high light emitting efficiency. Accordingly, the lighting device 1 according to the embodiment is suitable for the lighting device for vehicle.

When the accommodation unit 21 is closed using the lid unit 4, and light radiated from the light emitting unit 3 is emitted through an optical member such as a lens or a prism, a transmission loss of light due to the optical member occur;

however, in the lighting device 1 according to the embodiment, it is possible to obtain high light emitting efficiency since there is no transmission loss. In addition, since the heat radiation properties are improved, there is no need of increase in size due to enlargement of a volume of the accommodation unit 21 for the heat radiation properties, and it is possible to realize miniaturization. Accordingly, the lighting device 1 according to the embodiment is suitable for the lighting device for vehicle in which miniaturization is necessary.

The reflectance A (λ) and B (λ) are defined by a ratio Y/X of a total intensity Y of light of a visible light wavelength λ which is reflected on a reflecting face to a total intensity X of light of a visible light wavelength λ which is entered on the reflecting face. In reflection, there is specular reflection and diffuse reflection; however, it is assumed that the total intensity Y of light which is reflected includes specular reflection light and diffuse reflection light. The reflectance A (λ) and B (λ) can be measured using a measurement method based on the JIS standard (JIS K7375:2008), or a spectroreflectometer (for example, URE-50 made by Ushio Inc.) by setting at least a part of surface of the reflecting face to a measuring face.

Here, light which is radiated from the light emitting unit 3 has directivity based on light distribution properties of each light emitting element 31, or a shape of the reflector 34. Usually, the light emitting unit 3 radially radiates light as denoted by long dashed short dashed line in FIG. 4. Accordingly, when the opening portion 41 is configured of the inner peripheral face which is parallel to the thickness direction (long dashed double-short dashed line line in same figure), light which is radiated from the light emitting unit 3 is shielded by the lid unit top face 4*a*, and there is a concern that a light intensity of the lighting device 1 may be reduced. However, since the lighting device 1 according to the embodiment is configured of the slope face 41*a* in which the width of the inner peripheral face configuring the opening portion 41 becomes large toward the lid unit 4 side from the light emitting unit 3 side, that is, toward the light radiating direction of each light emitting element 31, it is possible to suppress a decrease in light intensity of the lighting device 1, and to maintain high efficiency. In addition, since it is possible to suppress shielding of light radiated from the light emitting unit 3 using the lid unit 4 because the opening angle α of the slope face 41*a* is equal to or greater than the half value angle β of the intensity of light from the light emitting unit 3, it is possible to efficiently emit light radiated from the light emitting unit 3 to the outside, and to maintain high efficiency.

Figure 6:
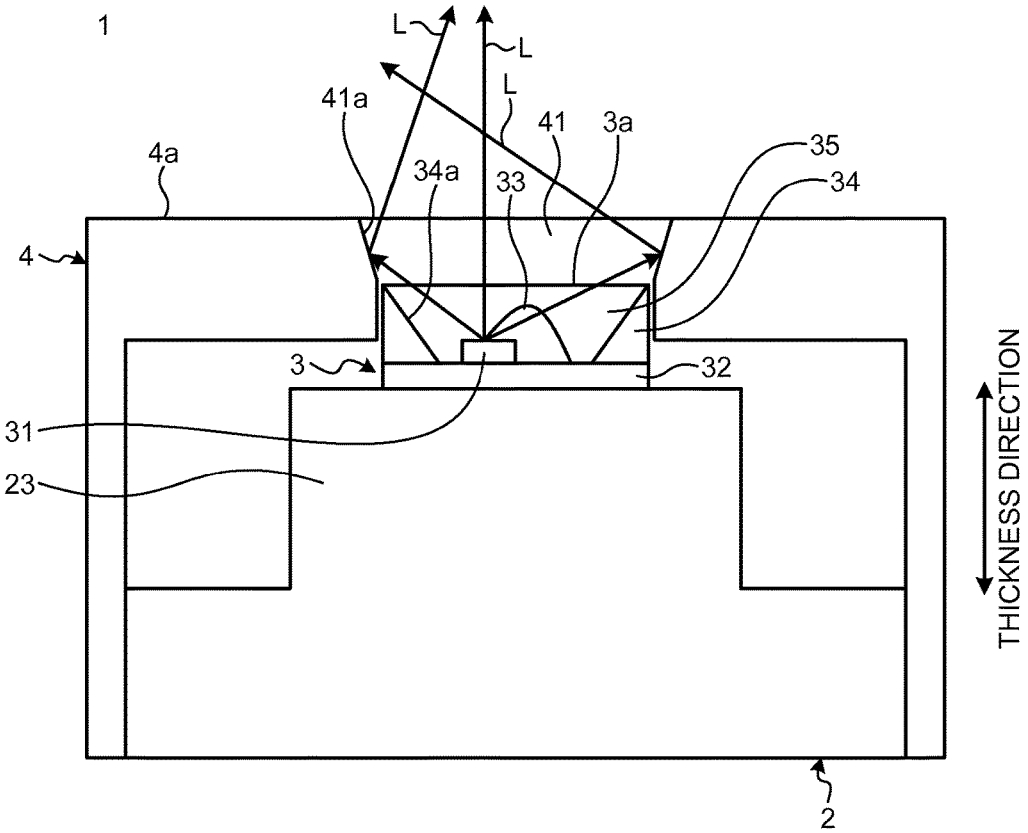
FIG. 6 is a diagram which illustrates another opening portion of the lighting device according to the embodiment.

According to the embodiment, the inner peripheral face which configures the opening portion 41 is described as a slope face so as to suppress shielding of light which is radiated from the light emitting unit 3; however, there is no limitation to this. FIG. 6 is a diagram which illustrates another opening portion of the lighting device according to the embodiment. As illustrated in the figure, the slope face 41*a* which is the inner peripheral face configuring the opening portion 41 may be set to a reflecting face on which total reflection or diffuse reflection is performed by stacking a reflecting film which is formed of a material such as aluminum using deposition, or the like. In this case, by causing light L with which the slope face 41*a* is irradiated without being taken out to the outside by penetrating the opening portion 41, in light beams L which are radiated from the light emitting unit 3, to be reflected on the slope face 41*a*, it is possible to cause the light to be emitted to the outside by penetrating the opening portion 41, as a result, and to maintain high efficiency. In addition, since the slope face 41*a* is set to a reflecting face, it is possible to adjust light distribution angle of light which is radiated to the outside of the lighting device 1 by adjusting the slope face 41*a* to a straight line shape, a curved line shape, or the like. Accordingly, it is possible to adjust a distribution angle of light which is radiated to the outside of the lighting device 1 without providing a light distribution adjusting member such as an optical component in the inside and outside of the opening portion 41.

Modification Example 1 of Embodiment

Figure 7:
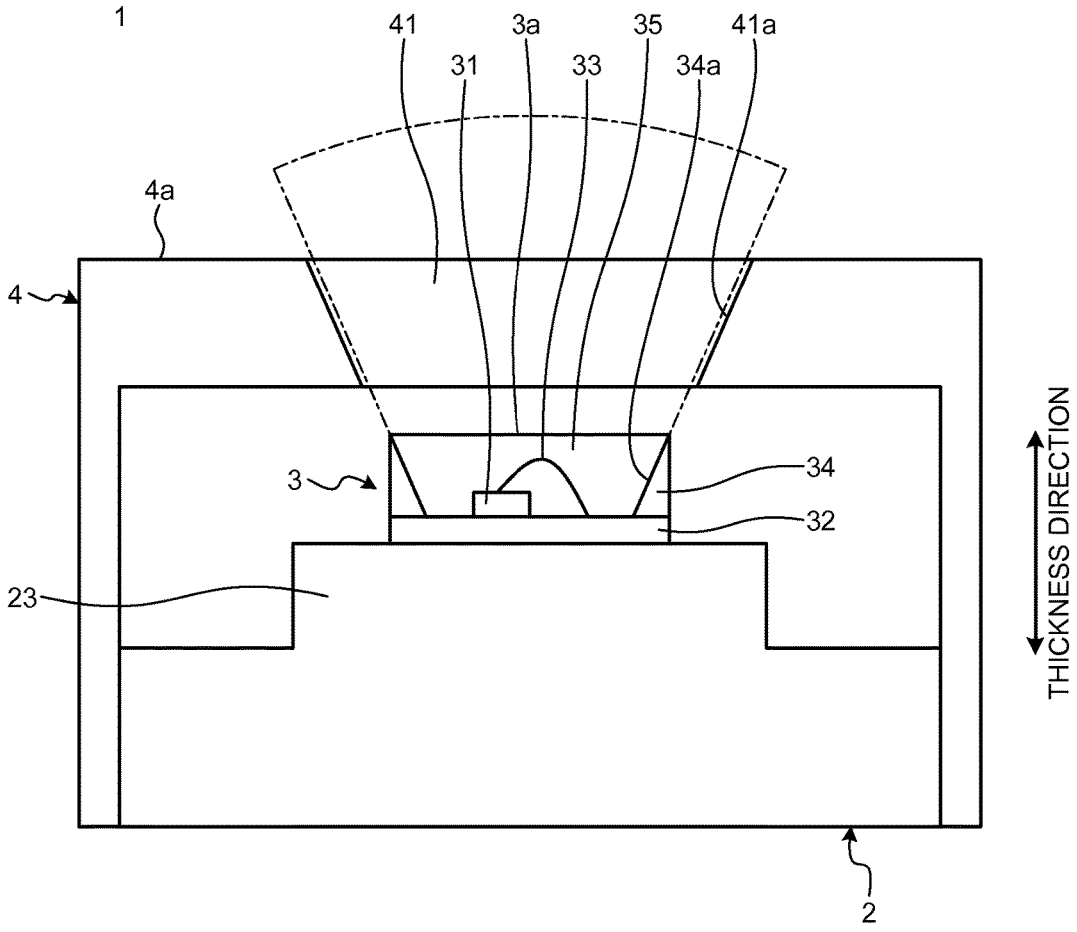
FIG. 7 is a diagram which illustrates a lighting device of a modification example.

According to the embodiment, a case in which, when the lid unit 4 is fixed to the socket unit 2, the light emitting unit 3 does not protrude from the opening portion 41, and the light emitting unit top face 3*a* is accommodated in the opening portion 41 is described; however, there is no limitation to this. FIG. 7 is a diagram which illustrates a lighting device as a modification example. As illustrated in the figure, the light emitting unit top face 3*a* may be located on the accommodation unit 21 side rather than the opening portion 41, that is, in the accommodation unit 21. In this case, since there is no case in which the lid unit 4 comes into contact with the light emitting unit 3 even when the lid unit moves with respect to the socket unit 2, it is possible to prevent deterioration in durability of the light emitting unit 3 due to damage.

Modification Example 2 of Embodiment

Figure 8:
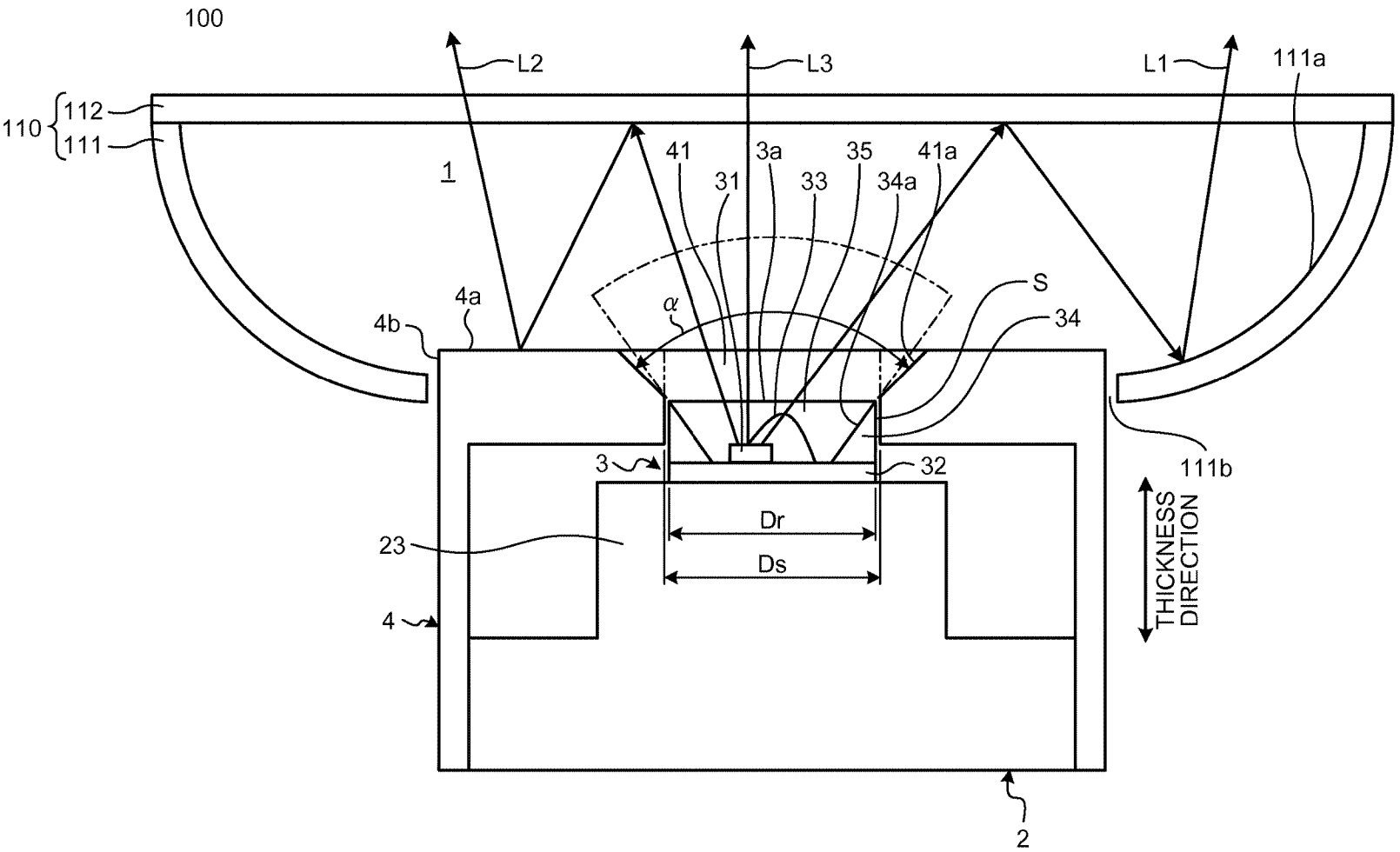
FIG. 8 is a schematic diagram which illustrates a lighting device for vehicle including the lighting device according to the embodiment.
Figure 9:
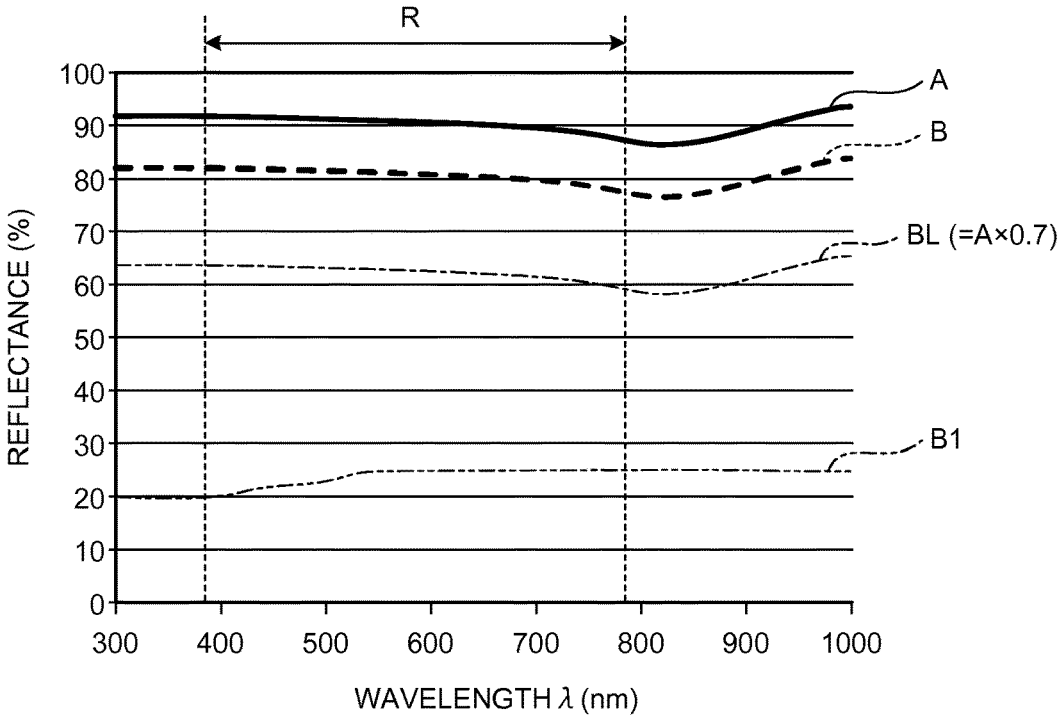
FIG. 9 is a diagram which illustrates a relationship between a reflecting face of a reflector and a reflecting face of a lid unit.
Figure 10:
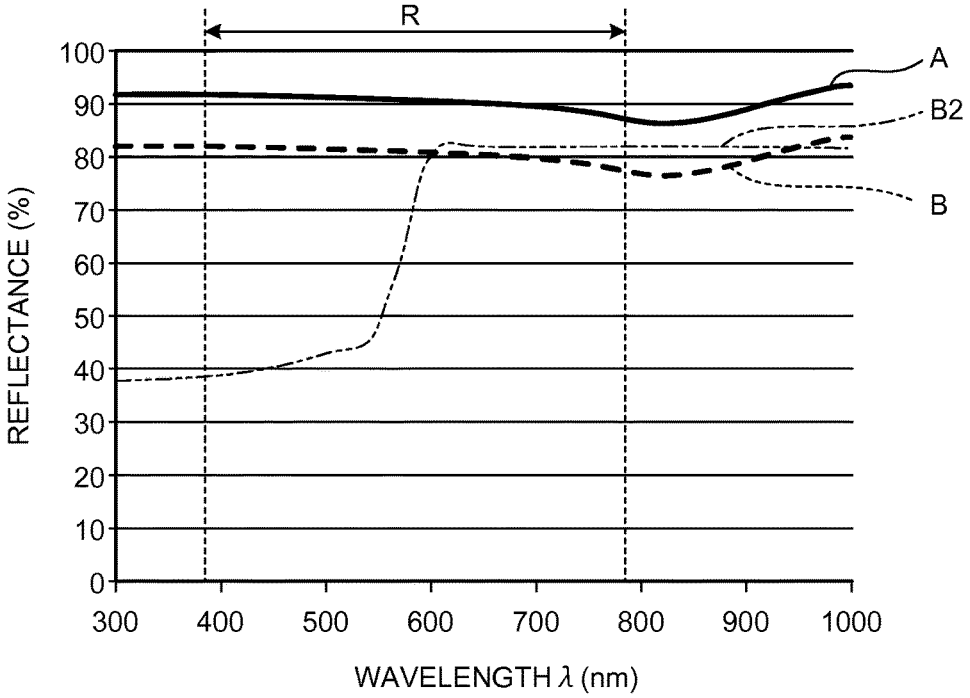
FIG. 10 is a diagram which illustrates a relationship between a reflecting face of a reflector and a reflecting face of a lid unit.

In the above-described embodiment, a lid unit reflecting face on which light radiated from the opening portion 41, and is reflected due to the lighting tool is reflected may be provided in the lid unit. FIG. 8 is a schematic diagram which illustrates a lighting device for vehicle including the lighting device according to the embodiment. FIG. 9 is a diagram which illustrates a relationship between a reflector reflecting face and a lid unit reflecting face. FIG. 10 is a diagram which illustrates a relationship between a reflector reflecting face and a lid unit reflecting face. In FIGS. 9 and 10, a vertical axis denotes reflectance (%), and a horizontal axis denotes a wavelength λ (nm). In the modification example, the lighting device for vehicle 100 includes one lighting device 1; however, there is no limitation to this, and the lighting device for vehicle may include two or more lighting devices 1.

As illustrated in FIG. 8, the lighting tool 110 radiates light which is radiated from the lighting device 1 to the outside at predetermined light distribution, and according to the modification example, to the outside of a vehicle body (not illustrated). The lighting tool 110 is configured by including a reflector 111 and a light transmission unit 112. Here, in the lighting device for vehicle 100, the light transmission unit 112 is exposed to the outside of a vehicle, and the reflector 111 and the lighting device 1 are arranged inside the vehicle.

The reflector 111 is formed in a concave shape, and is arranged by surrounding the lighting device 1. In the reflector 111, the inner peripheral face is a reflector reflecting face 111*a*. Usually, the reflector 111 is formed of a resin material, and the reflector reflecting face 111*a* becomes a mirror surface when a reflecting layer is formed on the inner peripheral face using a reflective material such as aluminum. In the reflector 111, an insertion hole 111*b* for exposing the lighting device 1 in the inside is formed. In addition, the lighting device 1, and in the modification example, a part of the lid unit 4 is inserted into the insertion hole 111*b* of the reflector 111, and a portion between the reflector 111 and the lighting device 1 is sealed using a packing 8 which will be described later.

The light transmission unit 112 is a clear lens which is formed of a material with permeability, and according to the modification example, a colorless and transparent resin material, glass, or the like, for example, and closes the inside of the reflector 111. Since the light transmission unit 112 has permeability, light radiated from the lighting device 1, light L1 which is reflected on the reflector reflecting face 111*a*, light L2 which is reflected on the lid unit reflecting face 42 which will be described below, or the like, penetrates the light transmission unit 112, and is radiated to the outside of the lighting tool 110, that is, radiated to the outside of the lighting device for vehicle 100.

The lid unit reflecting face 42 reflects light which is radiated from the opening portion 41, and is reflected by the lighting tool 110. In the modification example, the lid unit reflecting face 42 is the lid unit top face 4*a* which faces the light transmission unit 112 of the lighting tool 110. Usually, the lid unit 4 is formed of a resin material, and the lid unit reflecting face 42 becomes a mirror surface when a reflecting layer is formed on the lid unit top face 4*a* using a reflective material such as aluminum. The lid unit reflecting face 42 may not only include the lid unit top face 4*a* but also include a lid unit side face 4*b* which stretches to the socket unit 2 side from the outer periphery of the lid unit top face 4*a*. Here, the lid unit reflecting face 42 satisfies a relationship in the following expression (1) in a wavelength range R of light which is radiated from the lighting device 1 when reflectance of the reflector reflecting face 111*a* in a wavelength λ of light is set to A (λ), and reflectance of the lid unit reflecting face 42 is set to B (λ).

$$B(\lambda) \geq A(\lambda) \times 0.7 \quad (1)$$

Here, the wavelength range R of light which is radiated from the lighting device 1 means a wavelength range of light from the light emitting element 31 when there is no intervening member such as a reflecting member, or a transmission member on an optical path, and when there is an intervening member, the wavelength range R means a wavelength range of light which is radiated from the intervening member which is exposed to the outside of the lighting device 1. In the modification example, since the opening portion 41 is an opening, the wavelength range R becomes a wavelength range of light which is radiated from the light emitting unit 3. For example, as illustrated in FIG. 9, when the wavelength range R of light radiated from the light emitting unit 3 is a visible light region (appropriately 380 nm to 780 nm), in the modification example, since the lid unit reflecting face 42 is the mirror surface, it is possible to set the reflectance B (λ) of the lid unit reflecting face 42 to be 0.7 times or more of the reflectance A (λ) of the reflector reflecting face 111*a* in the entire region of the visible light region.

The reason why the reflectance B (λ) is set to 0.7 times of the reflectance A (λ), that is, to be equal to or greater than the threshold value BL (=A×0.7) is that, when it is less than 0.7 times, the reflectance B (λ) of the lid unit reflecting face 42 in the lighting tool 110 becomes lower than the reflectance A (λ) of the reflector reflecting face 111*a*, and luminance of the lid unit reflecting face 42 becomes low with respect to luminance of the reflector reflecting face 111*a*, and as a result, luminance unevenness becomes remarkable. It is preferable that a relationship between the reflectance A (λ) and the reflectance B (λ) is the following expression (2). By satisfying the expression (2), a design in an appearance of the lighting tool 110 which is viewed from the outside of the lighting device for vehicle 100 is further improved.

$$B(\lambda) \geq A(\lambda) \times 0.85 \quad (2)$$

Subsequently, operations of the lighting device for vehicle 100 will be described. The lighting device 1 is fixed to the lighting tool 110 which is fixed to a vehicle, and the power feeding member 7 is electrically connected to the external power supply. When a supply of power is started from the external power supply, power from the external power source which is supplied to the lighting circuit unit 5 through the power feeding member 7 is supplied to the light emitting element substrate 32 through the power feeding connection unit 6, the light emitting unit 3 emits light when each light emitting element 31 emits light due to supplied power, and the lighting device 1 is turned on. Light which is radiated from the light emitting unit 3 is radiated to the outside of the lighting device 1, that is, to the inside the lighting tool 110 through the opening portion 41, as illustrated in FIG. 8. The light which is radiated to the inside of the lighting tool 110 is directly radiated to the outside of the lighting device for vehicle 100 (L3 illustrated in the figure) through the light transmission unit 112, radiated to the light transmission unit 112 and the reflector reflecting face 111*a*, and is reflected. The light which is reflected in the inside of the lighting tool 110 is radiated to the outside of the lighting device for vehicle 100 (L1 illustrated in the figure) by being reflected on the reflector reflecting face 111*a* as a result, and is radiated to the outside of the lighting device for vehicle 100 by being reflected on the lid unit reflecting face 42 (L2 illustrated in the figure), and the lighting device for vehicle 100 is turned on.

Meanwhile, when considering heat radiation properties of a light emitting device in which a light emitting element is used as a light source, a heat radiation unit such as a heat sink becomes large in order to secure heat radiation properties. Accordingly, in the lighting device for vehicle, when a light emitting device is arranged in a lighting tool which includes a reflector, or the like, there is a problem that a percentage of the light emitting device in the lighting tool becomes large. For example, when the light transmission unit has permeability by being colorless and transparent, there is a concern that design in appearance of the lighting tool which is viewed from the outside of the lighting device for vehicle may be adversely influenced due to a difference in reflecting properties of members which configure the reflector and the light emitting device. In addition, when the light transmission unit, the reflector, or the like, has reflectivity, part of light which is radiated from the light emitting device is reflected by the light transmission unit or the reflector, and returns to the light emitting device; however, there is a concern that unevenness may occur in light which is radiated to the outside from the lighting tool, that is, light which is radiated from the lighting device for vehicle, due to a difference in reflectivity of members which configure the reflector and the light emitting device.

However, in the lighting device 1 and the lighting device for vehicle 100 according to the modification example, since the reflectance B (λ) of the lid unit reflecting face 42 is set to 0.7 times (threshold value BL) or more of the reflectance A (λ) of the reflector reflecting face 111*a* in the wavelength range R of light which is radiated from the lighting device 1, as illustrated in FIG. 9, the reflectance B (λ) becomes closer to the reflectance A (λ) in the whole area of the wavelength range R compared to a case in which reflectance of the lid unit top face 4*a* of the lid unit 4 is the reflectance B1 (λ) which is less than the threshold value BL. Accordingly, since the reflectance B (λ) of the lid unit reflecting face 42 is remarkably low with respect to the reflectance A (λ) of the reflector reflecting face 111*a*, it is possible to prevent luminance of the lid unit reflecting face 42 from becoming low with respect to luminance of the reflector reflecting face 111*a*. In this manner, it is possible to suppress luminance unevenness in the lighting tool 110, and it is possible to suppress an occurrence of unevenness in light which is radiated from the lighting device for vehicle 100, for example, when the inside of the lighting device for vehicle 100, that is, the inside of the lighting tool 110 is viewed from the outside, it is possible to prevent a part thereof from becoming dark.

Here, as illustrated in FIG. 10, when the reflectance B2 (λ) of the lid unit reflecting face 42 is set to be remarkably low with respect to the reflectance A (λ) of the reflector reflecting face 111*a* in a part of the wavelength region R of light, for example, when reflectance of a blue color is remarkably low with respect to the reflectance A (λ) of the reflector reflecting face 111*a* compared to reflectance of a red color or a green color, light which is reflected on the lid unit reflecting face 42 is viewed to be discolored with respect to light which is reflected by the reflector reflecting face 111*a*, and color unevenness occurs. However, in the lighting device 1 and the lighting device for vehicle 100 according to the modification example, since the reflectance B (λ) becomes approximate to the reflectance A (λ) in the whole area of the wavelength range R, it is possible to suppress discoloration of light which is reflected by the lid unit reflecting face 42 with respect to light which is reflected by the reflector reflecting face 111*a*. In this manner, it is possible to suppress color unevenness in the lighting tool 110, and to suppress unevenness of light which is radiated from the lighting device for vehicle 100, for example, partial discoloration when viewing the inside of the lighting device for vehicle 100, that is, the inside of the lighting tool 110 from the outside.

In addition, since the reflectance A (λ) and the reflectance B (λ) are approximate, and the reflector reflecting face 111*a* and the lid unit reflecting face 42 look approximate, it is possible to make the lighting device 1 not stand out in the lighting tool 110 even when the lighting device 1 is larger than the lighting tool 110, and a percentage of the lighting device 1 in the lighting tool 110 is large. Accordingly, it is possible to suppress an adverse influence on design in an appearance in the inside of the lighting tool 110 when viewed from the outside of the lighting device for vehicle 100, and to improve the design. In particular, when the light transmission unit 112 is colorless and transparent, the appearance in the lighting tool 110 can be easily viewed from the outside of the lighting device for vehicle 100, and accordingly, it is possible to further suppress the adverse influence on design, and to improve the design.

Since the reflector reflecting face 111*a* and the lid unit reflecting face 42 are mirror surfaces, and the reflectance B (λ) becomes more approximate to the reflectance A (λ), it is possible to further suppress unevenness in color which is radiated from the lighting device for vehicle 100. In addition, it is possible to make the lighting device 1 not stand out in the lighting tool 110, to further suppress the adverse influence on design in the appearance in the lighting tool 110 which is viewed from the outside of the lighting device for vehicle 100, and to further improve the design.

In the above-described modification example, the lid unit reflecting face 42 is a mirror surface, however, there is no limitation to this, and the reflectance B (λ) of the lid unit reflecting face 42 may be equal to or greater than 0.7 times of the reflectance A (λ) of the reflector reflecting face 111*a*. Accordingly, for example, the lid unit reflecting face 42 may be in white color. When the lid unit reflecting face 42 is in white color, light which is radiated to the lid unit reflecting face 42 is subjected to diffuse reflection in the lighting tool 110. In this manner, since reflection properties can be changed in the lighting tool 110, it is possible to control light distribution properties of the lighting device for vehicle 100. In addition, it is possible to improve design by exercising positive influence on the appearance in the lighting tool 110 viewed from the outside of the lighting device for vehicle 100, by making the lid unit reflecting face 42 different from the reflector reflecting face 111*a*.

In the above-described modified example, the wavelength range R of light which is radiated from the lighting device 1 is set to a visible light region; however, there is no limitation to this. For example, light of a wavelength (λ) which is obtained is different according to a use in the lighting device for vehicle 100 such as a red color in a stop lamp or a tail lamp, an orange color in a turn signal lamp, a white color or a yellow color in a fog lamp, and a white color in a back lamp. Therefore, when light radiated from the lighting device 1 is set to a wavelength (λ) which is obtained in advance, a wavelength range R of the light which is radiated from the lighting device 1 becomes a wavelength (λ) which is obtained according to a use of the lighting device for vehicle 100.

In the above-described modification example, the reflectance B (λ) of the lid unit reflecting face 42 is set to be equal to or greater than 0.7 times of the reflectance A (λ) of the reflector reflecting face 111*a* in the whole area of the wavelength range R of light which is radiated from the lighting device 1; however, it may be a part of region of the wavelength range R. In this manner, it is possible to control a color of light which is radiated from the lighting device for vehicle 100, since it is possible to prevent light with an arbitrary wavelength (λ) in the wavelength range R of light which is radiated from the lighting device 1 from being radiated from the lighting device for vehicle 100.

In the above-described modification example, the lighting device for vehicle 100 is described; however, it may be a LED lighting device when including the reflector 111 having the reflector reflecting face 111*a*, the lighting tool 110 having the light transmission unit 112, and the lighting device 1 which radiates light to the inside of the lighting tool 110.

In the above-described embodiment and the modification example, the light emitting element substrate 32 and the lighting circuit unit 5 are electrically connected using the power feeding connection unit 6 in a separated state; however, there is no limitation to this, and it may be a configuration in which the light emitting element 31 is mounted as one substrate, and the light emitting element 31 is turned on. In addition, in the above-described embodiment and the modification example, the reflector 34 is provided in the light emitting unit 3, and each light emitting element 31 is sealed using a resin; however, there is no limitation to this, and it may be a configuration in which any one of the reflector 34 and resin sealing 35 is not adopted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting device for vehicle comprising:

at least one or more lighting devices which include a socket unit, a light emitting unit which is accommodated in an accommodation unit of the socket unit, and includes a light emitting element, and a lid unit which includes a lid unit reflecting face, closes the accommodation unit of the socket unit, and in which an opening portion which causes light radiated from the light emitting element to pass through and functions as a ventilation port which causes the accommodation unit to communicate with the outside is formed, wherein an end face of the light emitting unit on the opening portion side overlaps with the opening portion in a thickness direction of the lid unit, and is located on the light emitting unit side rather than an end face of the lid unit on a side opposite to the light emitting unit side, and a lighting tool which is arranged outside the lid unit, and includes a reflector having a reflector reflecting face and a light transmission unit, wherein the lid unit reflecting face is exposed to an inside of the reflector and faces the light transmission unit, wherein the lighting device radiates light to an inside of the lighting tool, and wherein, $$B(\lambda) \geq A(\lambda) \times 0.7 \quad (1)$$

where A (λ) is reflectance of the reflector reflecting face, B (λ) is reflectance of the lid unit reflecting face, and λ is a wavelength of light radiated from the lighting device.

2. The device according to claim 1, wherein the opening portion is formed so as to be larger than an outer periphery of the light emitting unit.

3. The device according to claim 1, wherein the opening portion is formed in a slope face in which a width of an inner peripheral face becomes large toward an opposite side from the light emitting unit side.

4. The device according to claim 3, wherein an opening angle which is an angle of the slope face in a section including a thickness direction of the lid unit is equal to or greater than a half value angle of an intensity of light of the light emitting unit.

5. The device according to claim 3, wherein the slope face is a reflecting face which reflects light radiated from the light emitting element.

6. The device according to claim 1, wherein the lid unit reflecting face is a mirror surface.

7. The device according to claim 1, wherein the lid unit reflecting face is white color.

8. The device according to claim 1, wherein the light transmission unit is colorless and transparent.

* * * * *